US010789859B1

(12) United States Patent
Reese

(10) Patent No.: US 10,789,859 B1
(45) Date of Patent: Sep. 29, 2020

(54) GREETING CARD PLATFORM FOR BOTTLE CONTAINERS

(71) Applicant: Harvey Reese, Philadelphia, PA (US)

(72) Inventor: Harvey Reese, Philadelphia, PA (US)

( * ) Notice: Subject to any disclaimer, the term of this patent is extended or adjusted under 35 U.S.C. 154(b) by 0 days.

(21) Appl. No.: 16/525,604

(22) Filed: Jul. 30, 2019

(51) Int. Cl.
*G09F 1/10* (2006.01)
*B65D 23/14* (2006.01)
*G09F 1/04* (2006.01)

(52) U.S. Cl.
CPC ..... *G09F 1/10* (2013.01); *B65D 23/14* (2013.01); *G09F 1/04* (2013.01)

(58) Field of Classification Search
CPC ..... G09F 1/04; G09F 1/10; B65D 23/14
USPC .. 40/310, 124.05, 124.06, 649, 651, 607.03, 40/307.12, 611.08
See application file for complete search history.

(56) References Cited

U.S. PATENT DOCUMENTS 2,526,950 A * 10/1950 Jones ..... B42F 19/00 40/666
3,269,041 A * 8/1966 Marcus ..... G09F 3/185 40/649
3,977,109 A * 8/1976 Berry, Jr. ..... F24H 1/40 40/124.05
5,361,521 A * 11/1994 Burtch ..... G09F 1/04 40/750
2005/0039365 A1* 2/2005 Rosa ..... G09F 3/20 40/649
2011/0155625 A1* 6/2011 Franks ..... B65D 23/14 206/534
2012/0255882 A1* 10/2012 Glass ..... B65D 23/14 206/232
2015/0336415 A1* 11/2015 Fetters ..... B42D 15/042 40/124.09
2018/0037048 A1* 2/2018 Kight ..... B42D 15/042

* cited by examiner

*Primary Examiner* — Joanne Silbermann
(74) *Attorney, Agent, or Firm* — Michael J. Foycik, Jr.

(57) ABSTRACT

A device has a die-cut formed acetate main body that accommodates a standard size greeting card and affixes to a bottle container by an elastic band or, alternatively, by a rear-mounted adhesive strip. The platform body has rolled formed ends which secure the edges of the card. The card optionally being designed with specific dimensions, thereby allowing the front page of the card to swing freely open while secured.

18 Claims, 7 Drawing Sheets

GREETING CARD PLATFORM FOR BOTTLE CONTAINERS

CROSS REFERENCE TO RELATED APPLICATIONS

Not applicable

STATEMENT REGARDING FEDERALLY SPONSORED RESEARCH OR DEVELOPMENT

Not applicable

FIELD OF THE INVENTION

The present invention relates to platforms for displaying gift cards, and for attaching gift cards to packages and bottles.

BACKGROUND OF THE INVENTION

It is a problem in the art to provide a platform for affixing a gift card or greeting card to a bottle container.

There is a need in the art for platforms for displaying gift cards and greeting cards, and for attaching gift cards and greeting cards to packages and bottles.

SUMMARY OF THE INVENTION

From the foregoing, it is seen that it is a problem in the art to provide a device meeting the above requirements. According to the present invention, a device is provided which meets the aforementioned requirements and needs in the prior art. Specifically, the device according to the present invention provides a platform for displaying gift cards and greeting cards, and for attaching gift cards and greeting cards to packages and bottles.

Further, the present invention relates to a disposable die-cut acetate platform for attaching and displaying greeting cards and gift cards on bottle containers.

Other objects and advantages of the present invention will be more readily apparent from the following detailed description when read in conjunction with the accompanying drawings.

DETAILED DESCRIPTION OF THE INVENTION

Figure 1:
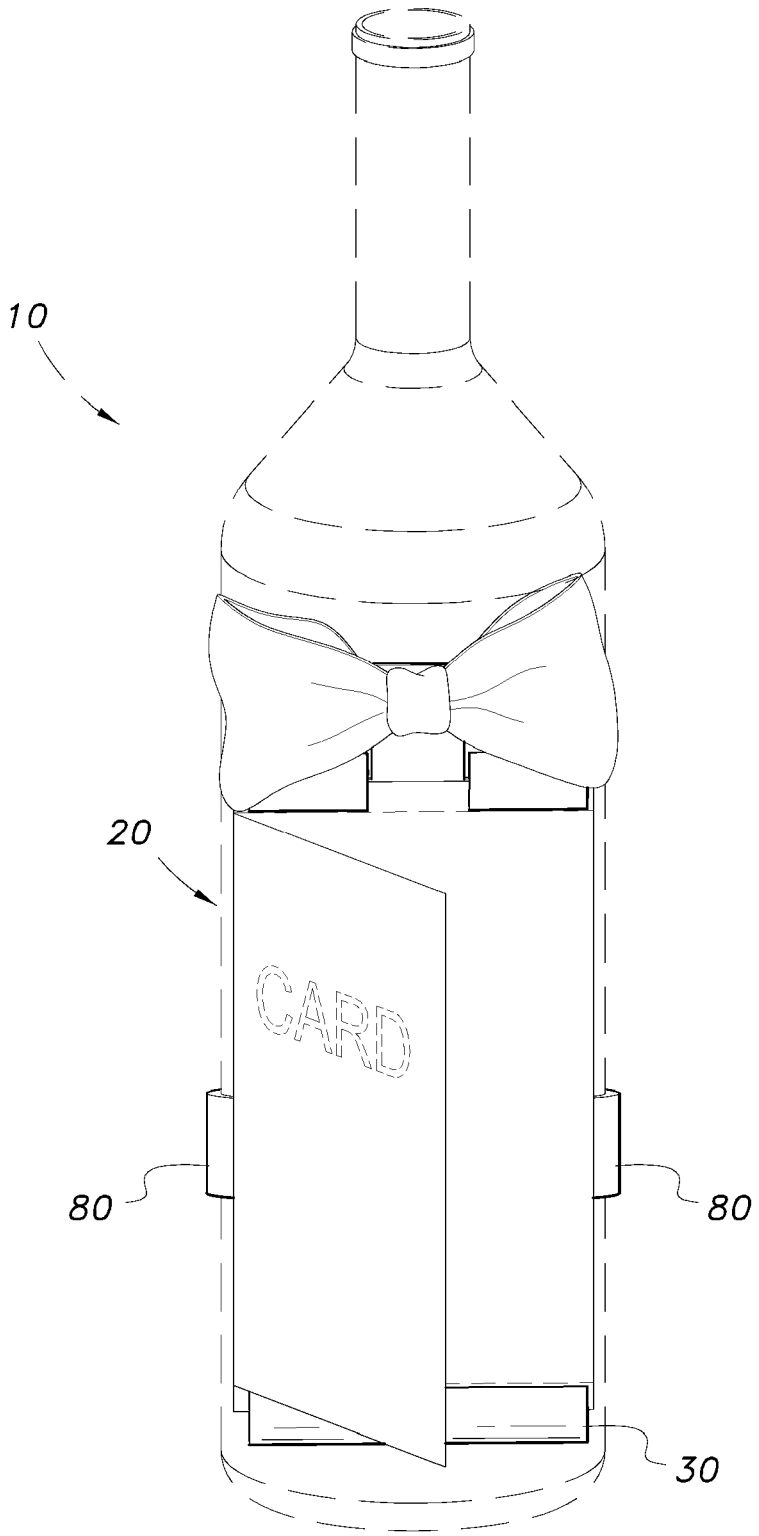
FIG. 1 is a front perspective view of a card platform mounted on a bottle, the bottle being shown in phantom outline, with the platform displaying a gift card or greeting card.

FIG. 1 is a front schematic view of a bottle 10 equipped with a greeting card platform 30 by means of an elastic band 80, with greeting card 20 installed. FIG. 1 is a front perspective view of a card platform 30 mounted on a bottle 10 by use of an elastic band 80. In this view, the bottle 10 is shown in phantom outline. Here, the platform 30 is displaying a card 20, the card 20 being a gift card or a greeting card.

In this discussion, the term card is intended to include greeting cards, gift cards, and any other types of cards which can be affixed to a gift. Other types of cards can include money cards, prepaid gift cards and envelopes, and others which would be known to any one having skill in the card arts.

Figure 2:
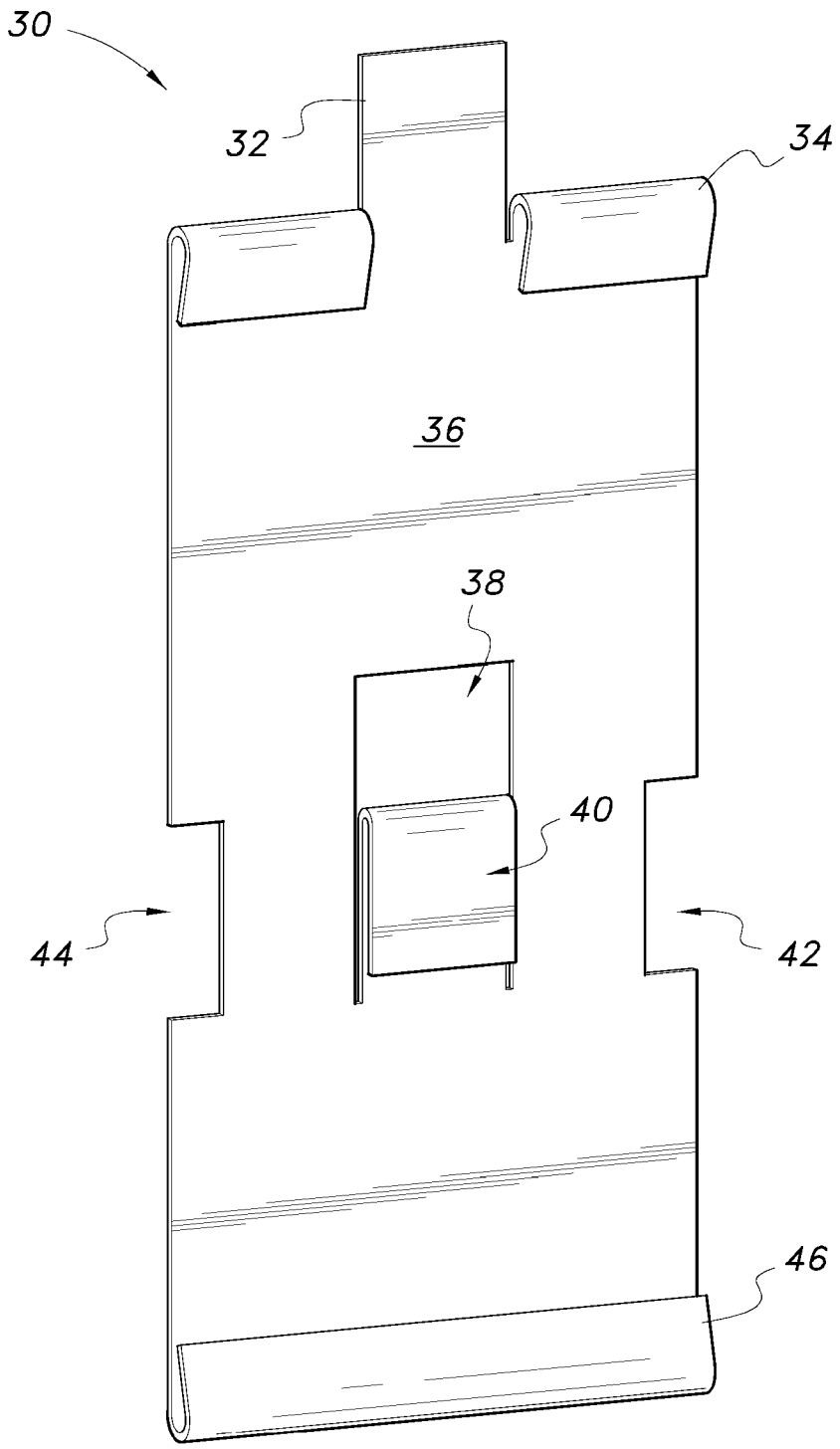
FIG. 2 is a front perspective view of the card platform of FIG. 1.

FIG. 2 is a front perspective view of the card platform 30. The card platform 30 is disposable and reusable. The card platform 30 is preferably formed as a single piece of formed, die cut acetate. The invention is not limited to this specific material, and other materials can be used which would be comparable in price and performance, which would be known to any one having skill in this art.

Figure 3:
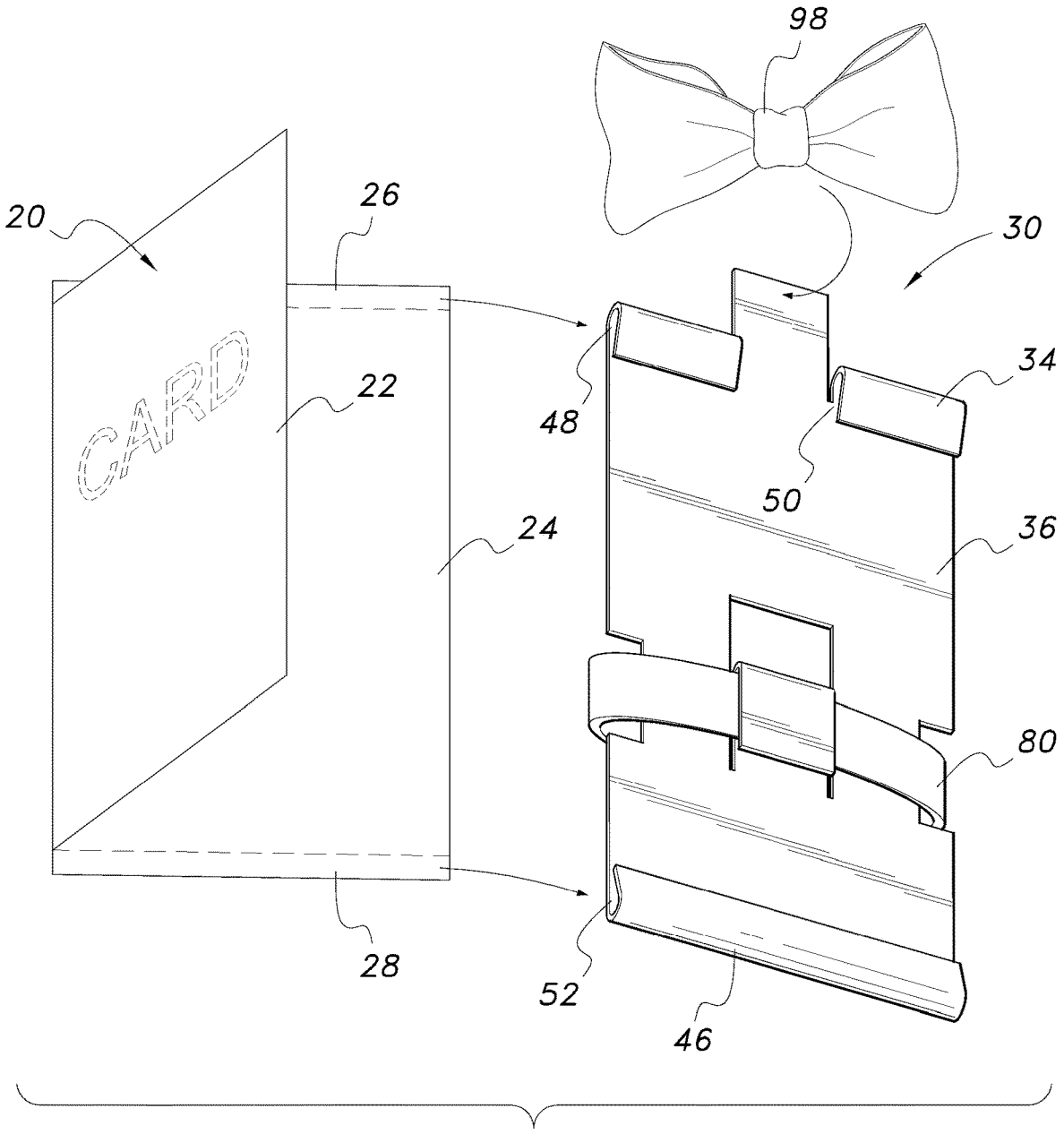
FIG. 3 is an front perspective view which is an assembly view of a card being inserted into the card platform, the gift card having a shape with dimensions that are adapted to fit with said card platform.
Figure 5:
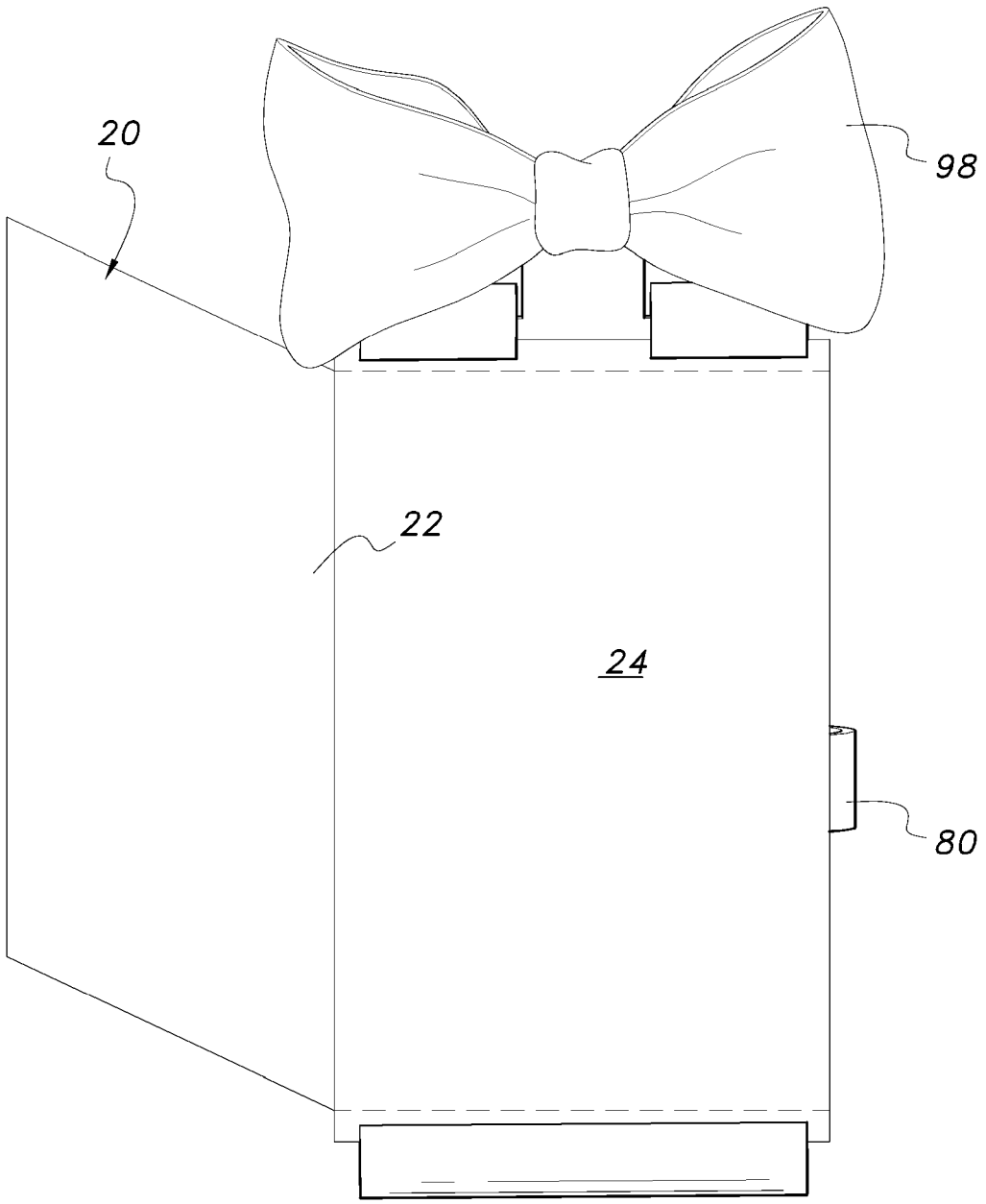
FIG. 5 is a front schematic view of the card platform with greeting card and envelope installed on said platform. In this view, the envelope is secured behind the greeting card. The front page of the card swings open freely, allowing the recipient to read the card's message.
Figure 7:
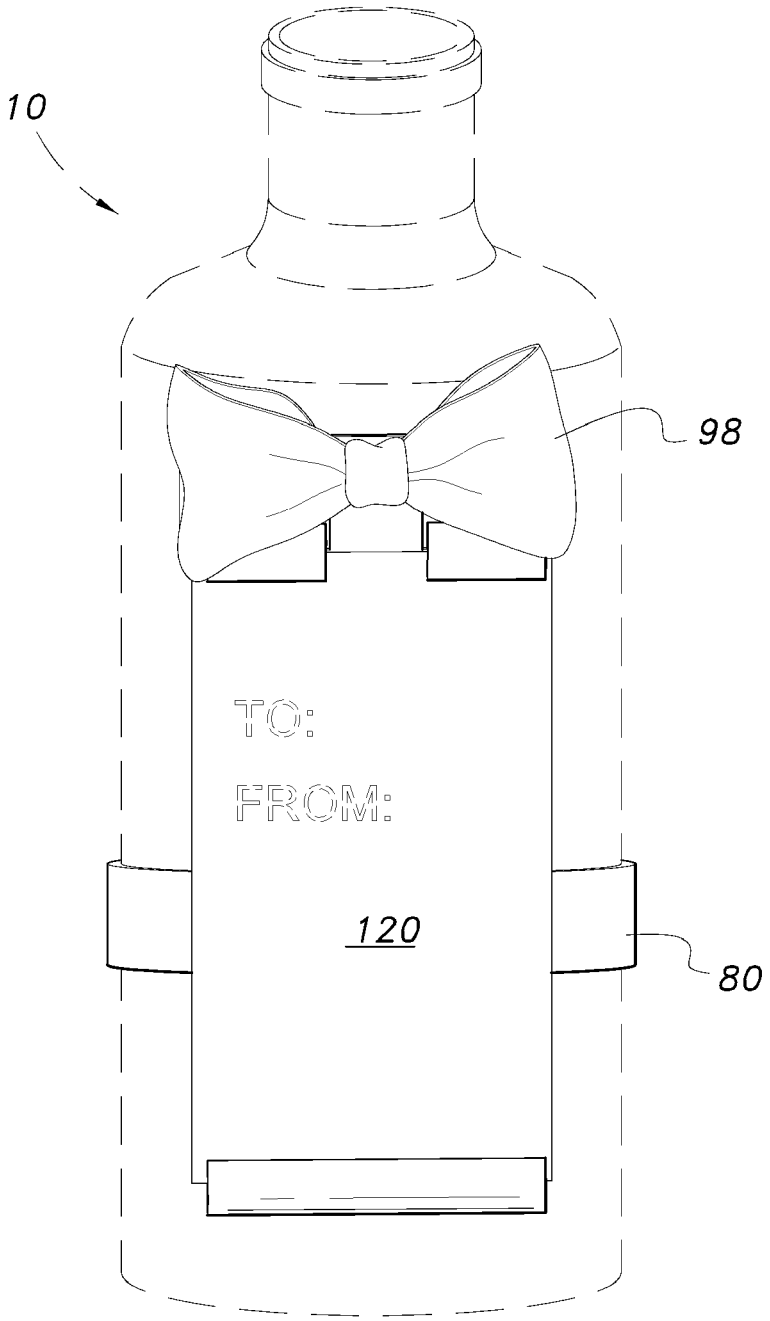
FIG. 7 is a front schematic view of the greeting card platform installed on a bottle, the bottle being shown in phantom outline, with the card and envelope installed on said platform. In this view, the card is sealed within the envelope.

The card platform 30 has a body 36; an extended tab 32 which can be used to affix a bow 98 as shown in FIG. 3, FIG. 5, and FIG. 7 or other such adornment; rolled formed ends 34 on either side of the tab 32 (only one such formed end being numbered in this view); and a rolled formed end 46 on the bottom of the body 36. The rolled formed ends 34 and 46 each have a respective slight gap between the main body 36 in order to accommodate and secure the edges of the card 20 (shown in FIG. 1). The card platform has an aperture 38 in the vicinity of its center, the aperture being formed by punching out and bending material from that portion into a hook 40. The hook 40 accommodates the elastic band 80 that secures the platform 30 to the bottle 10, and in use the hook 40 rests on an upper edge of the elastic band 80. The body 36 includes two opposed cutouts 42, 44, which receive the elastic band 80 such that the elastic band 80 operates without slipping off the card platform 30; and additionally it prevents bending the main body 36 or the greeting card 20 to the shape of the bottle 10.

As shown in FIG. 3, the platform 30 has gaps (serving as entry points) 48 and 50 on the uppermost side (formed by the rolled formed ends 34), and has a gap (serving as an entry point) 52 on the lowermost side (formed by the rolled formed end 46).

The elastic band 80 can be of any material that includes at least a portion that it stretchable or elastic, such that it provides tension when stretched, so as to retain its position on the bottle 10, for example, when stretched around the bottle 10 with the card platform 30.

In an alternative embodiment, the card platform 30 includes a peel-clean adhesive strip on its back surface (not shown). In this alternative embodiment, the card platform 30 is affixed to the bottle 10 with a peel-clean adhesive strip (not shown) on the the back of the main body 36.

FIG. 3 is a front assembly view, in perspective, of the card platform 30 alongside a card 20 cut with dimensions that function in tandem with the greeting card platform 30. The specially designed card 20 has both a front page 22 and back page 24; the back page 24 being slightly longer than the front page 22. The extended ends 26, 28, of the back page 24 are designed to slide securely into the gaps 48, 50 between the main body 36 and the rolled formed ends 34 of the greeting card platform 30, thus allowing the front page 22 to swing freely open to reveal the interior of the card 20. The extended ends 26, 28, of the back page 24 are perforated, so as to be removed and allow the card 20 to take on a familiar symmetry for the recipient.

Figure 4:
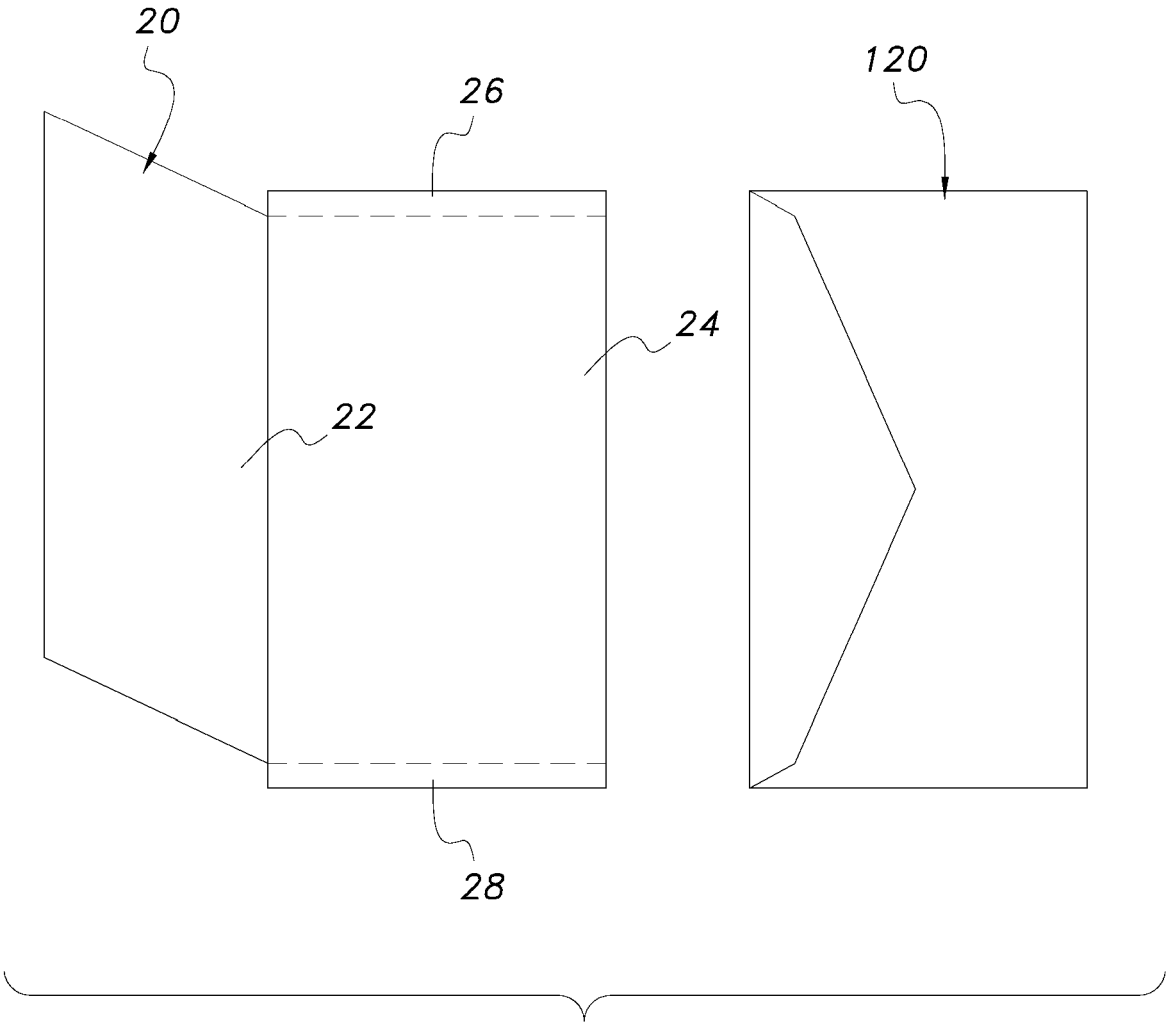
FIG. 4 is a front view of a greeting card or gift card and an envelope for receiving the card, both with dimensions adapted to fit with the card platform.

FIG. 4 is a front schematic view of a greeting card 20 and envelope 120, both with dimensions that function in tandem with the greeting card platform 30. The envelope 120 is sized to accommodate the elongated back page 24 of the card 20. Both the envelope 120 and the back page 24 of the card 20 can be held securely by the greeting card platform 30 in the gaps 48, 50, and 52 as described above.

FIG. 5 is a front schematic view of the card platform 30 with the greeting card 20 and the envelope 120 installed on the main body 36 of said platform 30 (which is not visible in this view, being covered by the card 20). In this view, the envelope 120 is secured behind the greeting card 20. The front page 22 of the card 20 swings open freely, allowing the recipient to read the card's message. Here, on one side, a small portion of the elastic band 80 is visible on the right hand side.

Figure 6:
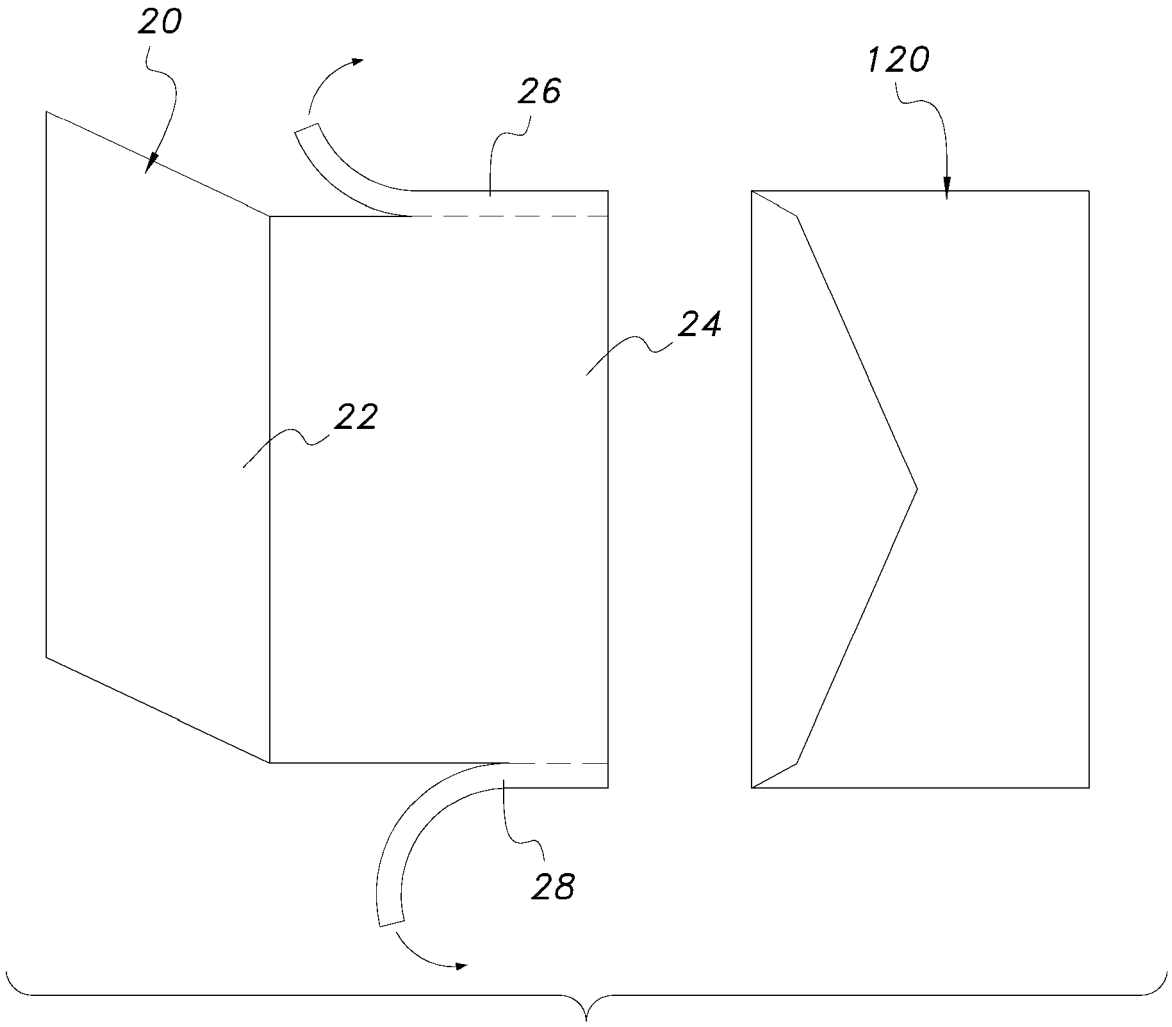
FIG. 6 is a front schematic view similar to FIG. 4, showing perforated edges of the card being removed, so that the card fits into the envelope.

FIG. 6 is a front schematic view similar to FIG. 4, showing the card 20 and the envelope 120, in which there are perforated edges 26, 28 of the greeting card 20 which are being removed in order to fit the card 20 into the envelope 120.

FIG. 7 is a front schematic view of the card platform 30 installed on the bottle 10, with the card 20 and the envelope 120 installed on the bottle 10 by means of the elastic band 80, in the manner described above. In this view, the greeting card 20 is sealed within the envelope 120.

What is claimed is:

1. A platform for attachment to a bottle, comprising:

a card adapted to be displayed, said card having a generally planar body portion, an upper edge, and a lower edge;

a card platform being adapted to receive said card for displaying said card;

said card platform having a body which has an upper edge and a lower edged, and a left side having a left side edge and a right side having a right side edge;

an extended tab portion disposed on said body and extending from said upper edge of said card platform;

a pair of rolled formed ends disposed on said card platform on opposite sides of said extended tab portion, each of said pair of rolled formed ends being adapted to receive said upper edge of said card to retain said card;

a lower rolled formed end disposed on said lower edge of said body of said card platform, said lower rolled formed end being adapted to receive said lower edge of said card to retain said card in supporting engagement on said card platform;

an elastic band for securing said card platform to said bottle;

a left side notch formed in said left side edge of said body of said card platform adapted to receive a portion of said elastic band;

a right side notch formed in said right side edge of said body of said card platform adapted to receive a portion of said elastic band; and a hook disposed on said body of said card platform, said hook being disposed between said left side notch and said right side notch; said hook being adapted to receive said elastic band such that said elastic band supports said body of said card platform when said elastic band is extended about said bottle.

2. A platform as claimed in claim 1, further comprising a bow attached to said extended tab portion.

3. A platform as claimed in claim 1, wherein said card has a front portion and a second portion, and wherein said front portion is hingedly connected to said second portion of said card.

4. A platform as claimed in claim 3, wherein said second portion of said card constitutes said generally planar body portion, and wherein said upper edge of said generally planar body portion of said card is adapted to be received in said pair of rolled formed ends, and wherein said lower edge of said generally planar body portion of said card is adapted to be received in said lower rolled formed end; whereby said card is supported by said body of said card platform.

5. A platform as claimed in claim 4, wherein said second portion of said card is larger than said first portion of said card, said first portion of said card being sized such that it is not retained by said pair of rolled formed ends and said lower rolled formed end.

6. A platform as claimed in claim 5, wherein said card has an open position wherein said first portion of said card is opened relative to said second portion of said card, and wherein said card has a closed position wherein said first portion of said card overlies said second portion of said card; whereby in said open position of said card, indicia disposed on said second portion of said card becomes visible.

7. A platform as claimed in claim 6, wherein said second portion of said card has an upper removable portion and a lower removable portion, such that removal of said upper removable portion and said lower removable portion causes said second portion of said card to match said first portion of said card such that said first portion of said card an directly overlie said second portion of said card with substantially no overlap.

8. A platform as claimed in claim 6, wherein said platform body is constituted by a die-cut, formed acetate material.

9. A platform as claimed in claim 1, wherein said card is a foldable greeting card having indicia thereon.

10. A platform as claimed in claim 1, wherein said card is a gift card.

11. A platform as claimed in claim 1, wherein said card is any one of a money card, a prepaid gift card, and an envelope.

12. A platform for attachment to a bottle in combination with a card, comprising:

a card adapted to be displayed, said card having a generally planar body portion, an upper edge, and a lower edge;

a card platform being adapted to receive said card for displaying said card;

said card platform having a body which has an upper edge and a lower edged, and a left side having a left side edge and a right side having a right side edge;

an extended tab portion disposed on said body and extending from said upper edge of said card platform;

a pair of rolled formed ends disposed on said card platform on opposite sides of said extended tab portion, each of said pair of rolled formed ends being adapted to receive said upper edge of said card to retain said card;

a lower rolled formed end disposed on said lower edge of said body of said card platform, said lower rolled formed end being adapted to receive said lower edge of said card to retain said card in supporting engagement on said card platform;

an elastic band for securing said card platform to said bottle;

a left side notch formed in said left side edge of said body of said card platform adapted to receive a portion of said elastic band;

a right side notch formed in said right side edge of said body of said card platform adapted to receive a portion of said elastic band; and a hook disposed on said body of said card platform, said hook being disposed between said left side notch and said right side notch; said hook being adapted to receive said elastic band such that said elastic band supports said body of said card platform when said elastic band is extended about said bottle.

13. The combination as claimed in claim 12, further comprising a bow attached to said extended tab portion.

14. The combination as claimed in claim 13, wherein said card has a front portion and a second portion, and wherein said front portion is hingedly connected to said second portion of said card.

15. The combination as claimed in claim 14, wherein said second portion of said card constitutes said generally planar body portion, and wherein said upper edge of said generally planar body portion of said card is adapted to be received in said pair of rolled formed ends, and wherein said lower edge of said generally planar body portion of said card is adapted to be received in said lower rolled formed end; whereby said card is supported by said body of said card platform.

16. A method for displaying a card on a bottle, comprising the steps of:

providing a card adapted to be displayed, said card having a generally planar body portion, an upper edge, and a lower edge;

providing a card platform being adapted to receive said card for displaying said card;

in said step of providing a card platform, providing said card platform with a body which has an upper edge and a lower edged, and a left side having a left side edge and a right side having a right side edge; and providing an extended tab portion on said body extending from said upper edge of said card platform; and providing a pair of rolled formed ends disposed on said card platform on opposite sides of said extended tab portion, each of said pair of rolled formed ends being adapted to receive said upper edge of said card to retain said card; providing a lower rolled formed end disposed on said lower edge of said body of said card platform, said lower rolled formed end being adapted to receive said lower edge of said card to retain said card in supporting engagement on said card platform;

providing an elastic band for securing said card platform to said bottle;

providing a left side notch formed in said left side edge of said body of said card platform adapted to receive a portion of said elastic band;

providing a right side notch formed in said right side edge of said body of said card platform adapted to receive a portion of said elastic band; and providing a hook disposed on said body of said card platform, said hook being disposed between said left side notch and said right side notch;

providing a bottle having a body portion and a neck portion;

assembling said elastic band with said card platform, and applying said elastic band about said body of said bottle such that said elastic band is stretched sufficiently to provide tension for supporting said card platform on said bottle, including providing that said hook rests on said elastic band such that said elastic band supports said body of said card platform when said elastic band is extended about said bottle.

17. The method of claim 16, further comprising the steps of:

providing a bow for attachment to said extended tab portion, and attaching said bow to said extended tab portion.

18. The method of claim 16, wherein in said step of providing said card, providing said card with a front portion and a second portion, and providing that said front portion is hingedly connected to said second portion of said card; and wherein in said step of providing said card, providing that said second portion of said card constitutes said generally planar body portion, and providing that said upper edge of said generally planar body portion of said card is adapted to be received in said pair of rolled formed ends, and wherein said lower edge of said generally planar body portion of said card is adapted to be received in said lower rolled formed end.

* * * * *